US009759221B2

(12) United States Patent
Kabasawa

(10) Patent No.: US 9,759,221 B2
(45) Date of Patent: Sep. 12, 2017

(54) VACUUM PUMP

(75) Inventor: Takashi Kabasawa, Chiba (JP)

(73) Assignee: Edwards Japan Limited, Chiba (JP)

( * ) Notice: Subject to any disclaimer, the term of this patent is extended or adjusted under 35 U.S.C. 154(b) by 586 days.

(21) Appl. No.: 13/697,982

(22) PCT Filed: May 20, 2011

(86) PCT No.: PCT/JP2011/062148
§ 371 (c)(1),
(2), (4) Date: Dec. 14, 2012

(87) PCT Pub. No.: WO2011/162070
PCT Pub. Date: Dec. 29, 2011

(65) Prior Publication Data

US 2013/0115094 A1 May 9, 2013

(30) Foreign Application Priority Data

Jun. 24, 2010 (JP) ..... 2010-144233

(51) Int. Cl.
*F04D 19/04* (2006.01)
*F04D 29/02* (2006.01)

(52) U.S. Cl.
CPC ..... *F04D 19/042* (2013.01); *F04D 19/044* (2013.01); *F04D 29/023* (2013.01); *F05D 2300/43* (2013.01); *F05D 2300/603* (2013.01)

(58) Field of Classification Search
CPC ..... F04D 19/04; F04D 19/042; F04D 19/044; F04D 19/046
See application file for complete search history.

(56) References Cited

U.S. PATENT DOCUMENTS 6,887,032 B2 * 5/2005 Favre-Felix et al. ..... 415/90
2007/0071992 A1 * 3/2007 Okoroafor ..... 428/632

FOREIGN PATENT DOCUMENTS

JP 62203721 A 9/1987
JP 3098139 B2 10/2000
JP 2004278512 A 10/2004

OTHER PUBLICATIONS

PCT International Search Report dated Aug. 16, 2011 for corresponding PCT Application No. PCT/JP2011/062148, filed May 20, 2011.

(Continued)

*Primary Examiner* — Richard Edgar
(74) *Attorney, Agent, or Firm* — Theodore M. Magee; Westman, Champlin & Koehler, P.A.

(57) ABSTRACT

Provided is a vacuum pump in which no finish processing has to be carried out after shaping of a cylindrical rotor even in use of a cylindrical rotor obtained by shaping a fiber-reinforced plastic material into a cylindrical shape. The vacuum pump has a turbo-molecular pump section and a thread groove pump section. The upper end section of a cylindrical rotor, which is obtained by shaping a fiber-reinforced plastic material into a cylindrical shape, of the thread groove pump section, is joined to the lower end section of a rotor of the turbo-molecular pump section. A joining portion of the rotor of the turbo-molecular pump section and the cylindrical rotor of the thread groove pump section is disposed upstream of an exhaust passage. As a result, finish processing does not have to be carried out after shaping of the cylindrical rotor. If finish processing is performed after shaping of the cylindrical rotor a resin may be coated onto a rugged portion of the cylindrical rotor, or fibers may be helically wound at a winding angle not greater than 45 degrees.

16 Claims, 3 Drawing Sheets

(56) References Cited

OTHER PUBLICATIONS

PCT Written Opinion dated Aug. 16, 2011 for corresponding PCT Application No. PCT/JP2011/062148, filed May 20, 2011.

* cited by examiner

VACUUM PUMP

BACKGROUND OF THE INVENTION

1. Field of the Invention

The present invention relates to a vacuum pump, and more particularly to a vacuum pump that can be used in a pressure range from medium vacuum to high vacuum and ultra-high vacuum, in an industrial vacuum system used in semiconductor manufacturing, high-energy physics and the like.

2. Description of the Related Art

Conventional vacuum pumps of this type have a structure wherein a turbo-molecular pump section and a cylindrical thread groove pump section are sequentially disposed inside a chassis that has an intake port and an exhaust port.

The rotor or stator at the cylindrical thread groove pump section is made of an aluminum alloy. Thus, the raise of vacuum pump revolution speed is limited by the strength of the rotor at the cylindrical thread groove pump section.

Such being the case, a cylindrical rotor that results from shaping, to a cylindrical shape, a fiber-reinforced plastic material (fiber-reinforced plastic, ordinarily referred to as "FRP material"), may be used as the rotor in the thread groove pump section of the vacuum pump. Structures for increasing the strength of such a cylindrical rotor are also known. When in rotation, the cylindrical rotor is acted upon, in the circumferential direction, by a load that results from differences in centrifugal force and between coefficients of thermal expansion. In the case of FRP, therefore, a layer in which the fibers are aligned along the circumferential direction is ordinarily formed on the outermost side. As the fiber-reinforced plastic material there can be used, for instance, aramid fibers, boron fibers, carbon fibers, glass fibers, polyethylene fibers and the like.

In a case where the fiber-reinforced plastic material (hereafter, FRP material) is shaped in the form of a cylinder to yield a cylindrical rotor, the surface after shaping of the FRP material to a cylindrical shape is significantly distorted, and hence finish processing is required after shaping. However, the meandering fibers in the vicinity of the surface layer of the cylindrical rotor are shredded during this finish processing. When acted upon by a high load, therefore, the fibers in the FRP material may partially peel off, become frayed and/or distorted, and be damaged as a result.

Conventional measures against the above occurrences have been proposed in, for instance, Japanese Patent Publication No. 3098139 and Japanese Patent Application Publication No. 2004-278512.

In a vacuum pump of Japanese Patent Publication No. 3098139, specifically, a rotor of a turbo-molecular pump section and a cylindrical rotor of a thread groove pump section are joined to each other by way of a support plate of FRP material, in order to mitigate the difference in the extent of deformation caused by centrifugal force and by differences in thermal expansion between the turbo-molecular pump section and the thread groove pump section.

In the vacuum pump disclosed in Japanese Patent Application Publication No. 2004-278512, the winding angle of fibers of an FRP material, as well as shapes and shaping conditions, such as resin content, are so designed as to mitigate the difference in the extent of deformation caused by centrifugal force and differences in thermal expansion between the turbo-molecular pump section and the thread groove pump section.

The structure disclosed in Japanese Patent Publication No. 3098139, wherein the rotor in the turbo-molecular pump section and the cylindrical rotor in the thread groove pump section are joined to each other by way of a support plate of a FRP material, as a measure against the occurrence of fiber fraying and distortion and resulting damage of fibers, in a cylindrical rotor that is obtained by shaping a conventional FRP material to a cylindrical shape, as described above, is problematic structure on account of the increased number of parts and greater assembly man-hours that such a structure involves. In some instances, moreover, assembly is difficult to achieve with good precision, and the clearance with respect to a fixed section must be widened in order to prevent contact with the fixed section. This entails lower evacuation performance, which is likewise problematic.

In a structure as disclosed in Japanese Patent Application Publication No. 2004-278512, i.e., a structure in which the winding angle of fibers of an FRP material, and shaping shapes and conditions, such as resin content, are variously designed, the shape of the FRP material is complex, which is problematic in terms of poorer productivity and higher costs.

SUMMARY OF THE INVENTION

Therefore, it is an object of the present invention to solve the technical problem of the invention, namely preventing partial peeling and damage to the surface of a cylindrical rotor, also when using a cylindrical rotor that is obtained by shaping a fiber-reinforced plastic material to a cylindrical shape.

The present invention is proposed in order to achieve the above object. The invention set forth in claim 1 provides a vacuum pump having a rotor such that a cylindrical rotor formed to a substantially cylindrical shape out of a fiber-reinforced composite material is joined to a rotor of another material, and forming a thread groove pump, wherein the cylindrical rotor is formed as a multilayer structure that comprises hoop layers in which fibers are oriented in less than 45 degrees with respect to a circumferential direction, and a protective countermeasure is provided at an outer periphery of an outermost layer, from among the hoop layers, so as to prevent shredding fibers in the layer that constitutes the outermost layer at least at a joining portion of the cylindrical rotor.

In a vacuum pump configured as described above, where the vacuum pump has a rotor such that a cylindrical rotor formed in a substantially cylindrical shape out of a fiber-reinforced composite material is joined to a rotor of another material, this vacuum pump forms a thread groove pump, the cylindrical rotor is formed as a multilayer structure that includes hoop layers in which fibers are aligned by less than 45 degrees with respect to a circumferential direction. Specifically, a ring-like layer is formed through winding of fibers at an angle less than 45 degrees with respect to the circumferential direction of the cylindrical rotor. Further, a protective countermeasure is provided at an outer periphery of an outermost layer, from among the hoop layers, so as to prevent shredding fibers in the layer that constitutes the outermost layer at a joining portion of the cylindrical rotor.

The invention set forth in claim 2 provides the vacuum pump according to claim 1, wherein at least at the joining portion in the cylindrical rotor, a resin layer is provided outside of the hoop layers so as to reduce irregularities in the surface of the cylindrical rotor.

In such a configuration, a resin layer is provided outside of the hoop layers at a joining portion of the cylindrical rotor. As a result, this allows reducing irregularities in the surface of the cylindrical rotor. Methods that can be resorted to for forming the resin layer to a smooth-surface shape include a method wherein a resin material is sprayed into recesses in the surface of the cylindrical rotor, to fill thereby the interior of the recesses; a method of brush-coating the resin material onto the surface of the cylindrical rotor, to cause the resin to fill thereby the interior of the recesses, or a method that involves securing shape and dimensional precision by casting or die molding.

The invention set forth in claim 3 provides the vacuum pump according to claim 2, wherein after the resin layer is provided, the resin layer is subjected to removal processing within the thickness range of the resin layer.

In such a configuration, the resin layer is formed on the surface of the cylindrical rotor, and thereafter, the resin layer is subjected to removal processing within the thickness range of the resin layer. Therefore, irregularities in the surface of the cylindrical rotor can be reduced and surface finish precision can be enhanced.

The invention set forth in claim 4 provides the vacuum pump according to claim 2 or 3, wherein the resin layer is formed by resin casting.

In such a configuration, the resin layer formed outside of the hoop layers at the joining portion of the cylindrical rotor is formed through injection of a resin into a mold. Therefore, dimensional precision can be secured even without carrying out removal processing.

The invention set forth in claim 5 provides the vacuum pump according to claim 1, wherein at least at the joining portion in the cylindrical rotor, a helical layer in which fibers are oriented in 45 degrees or more with respect to the circumferential direction is provided outside of the hoop layers.

In such a configuration, a helical layer in which fibers are aligned by 45 degrees or more with respect to the circumferential direction is further provided outside of the hoop layers, at the joining portion of the cylindrical rotor.

The invention set forth in claim 6 provides the vacuum pump according to claim 5, wherein after the helical layer is provided, fibers wound in the helical layer and resin around the fibers are subjected to removal processing within the thickness range of the helical layer.

In such a configuration, after the helical layer has been provided outside of the hoop layers at the joining portion of the cylindrical rotor, fibers wound in the helical layer, and resin around the fibers, are subjected to removal processing within the thickness range of the helical layer. The fibers wound in the helical layer are aligned by 45 degrees or more with respect to the circumferential direction. Even if a load is acting in the circumferential direction, therefore, no substantial load acts on the fibers of the helical layer. Partial peeling of the surface of the cylindrical rotor can be prevented as a result.

The invention set forth in claim 7 provides the vacuum pump according to claim 1, wherein in the cylindrical rotor that is formed in such a manner that the hoop layers constitute an outermost layer, the range of removal processing in the outer periphery of the cylindrical rotor is at least a part of a portion other than the joining portion.

In such a configuration, the range of removal processing in the outer periphery of the cylindrical rotor, which is formed in such a manner that the hoop layers constitute an outermost layer, is at least a part of a portion other than the joining portion. Concerns regarding the loss of marketability of the vacuum pump are dispelled thereby.

The invention set forth in claim 8 provides the vacuum pump according to claim 1, 2, 3, 4, 5, 6 or 7, wherein the joining portion is provided upstream of an exhaust passage of the thread groove pump.

In such a configuration, the joining portion of the cylindrical rotor is provided upstream of an exhaust passage of the thread groove pump. Specifically, the surface portion of the cylindrical rotor is rugged in a case where the cylindrical rotor is obtained by shaping a fiber-reinforced plastic material to a cylindrical shape. Therefore, the gap with respect to a component that stands opposite must be increased if the cylindrical surface is not subjected to finish processing. In the vacuum pump of the present embodiment, however, the joining portion between the rotor of the turbo-molecular pump section and the cylindrical rotor of the thread groove pump section is disposed upstream of the exhaust passage, where the pressure is lower than on the exhaust port side, at which the influence of a wider gap is smaller. Therefore, gas is discharged through the exhaust port, without incurring a significantly lower exhaust rate or compression ratio, even if there is a large gap between the cylindrical rotor and the opposing component. Therefore, the finish processing after shaping of the cylindrical rotor need not be carried out for at least the joining portion, under load, of the cylindrical rotor that is obtained by shaping fiber-reinforced plastic material to a cylindrical shape.

In the invention of claim 1, a protective countermeasure is provided on the outer periphery of the outermost layer. As a result, fibers in the hoop layers acted upon by a large load do not become shredded, and hence the strength thereof can be expected to increase.

In the invention of claim 2, smoothing of the outermost hoop layer is achieved through resin coating, instead of through smoothing by removal processing. Therefore, fibers in hoop layers acted upon by a large load do not become shredded, and hence the strength thereof can be expected to increase.

In the invention of claim 3, the resin layer formed on the surface of the cylindrical rotor is subjected to removal processing within the thickness range of the resin layer. In addition to the effects elicited by the invention of claim 2, therefore, irregularities in the surface of the cylindrical rotor can be reduced and surface finish precision can be enhanced. In other words, a processing allowance is provided on the outermost layer of the upper end section corresponding to the joining portion of the cylindrical rotor, and after shaping of the cylindrical rotor, finish processing is performed only on the portion of the processing allowance, so that the finish conforms to a predetermined precision. Enhanced processing precision can be expected as a result.

In the invention of claim 4, the resin layer formed outside of the hoop layers is formed through injection of a resin into a mold. In addition to the effect elicited by the invention of claim 2, doing so allows shaping the cylindrical rotor with good processing precision, without incurring an increase in the number of processes.

In the invention of claim 5, a helical layer in which fibers are aligned by 45 degrees or more with respect to the circumferential direction is further provided outside of the hoop layers, at the joining portion of the cylindrical rotor. Therefore, fibers in hoop layers acted upon by a large load do not become shredded, and hence the strength thereof can be expected to increase.

In the invention of claim 6, fibers wound in the helical layer, and resin around the fibers, are subjected to removal processing within the thickness range of the helical layer. In addition to the effects elicited by the invention of claim 5, irregularities in the surface of the cylindrical rotor can thus be reduced and surface finish precision can thus be enhanced. Even if a load acts in the circumferential direction, no large load acts on the fibers, since fibers are aligned by 45 degrees or more with respect to the circumferential direction. Partial peeling is averted as a result.

In the invention of claim 7, the removal processing range is limited to just a part of a portion, other than the joining portion, of the outer peripheral portion of the cylindrical rotor, and thus fibers in the hoop layers at the joint, on which a large load acts, do not break. The strength of the fibers can be expected to be enhanced as a result.

In the invention of claim 8, evacuation performance is little affected also upon widening of the clearance with respect to a fixed section when pressure is low; also, the joining portion is provided upstream of the exhaust passage. As a result, high marketability can be preserved even in case of poor finishing precision of the outer peripheral face of the joining portion.

DESCRIPTION OF THE PREFERRED EMBODIMENTS

The object of preventing low-load damage to a cylindrical rotor, even when using a cylindrical rotor obtained by shaping a fiber-reinforced plastic material to a cylindrical shape, is attained by providing a vacuum pump having rotors such that a cylindrical rotor formed to a substantially cylindrical shape out of a fiber-reinforced composite material is joined to a rotor of another material, and forming a thread groove pump, wherein the cylindrical rotor is formed as a multilayer structure that comprises hoop layers in which fibers are aligned by less than 45 degrees with respect to a circumferential direction, and a protective countermeasure is provided at an outer periphery of an outermost layer, from among the hoop layers so as to prevent shredding fibers in the layer that constitutes the outermost layer, at least at a joining portion of the cylindrical rotor.

Embodiments

Figure 1:
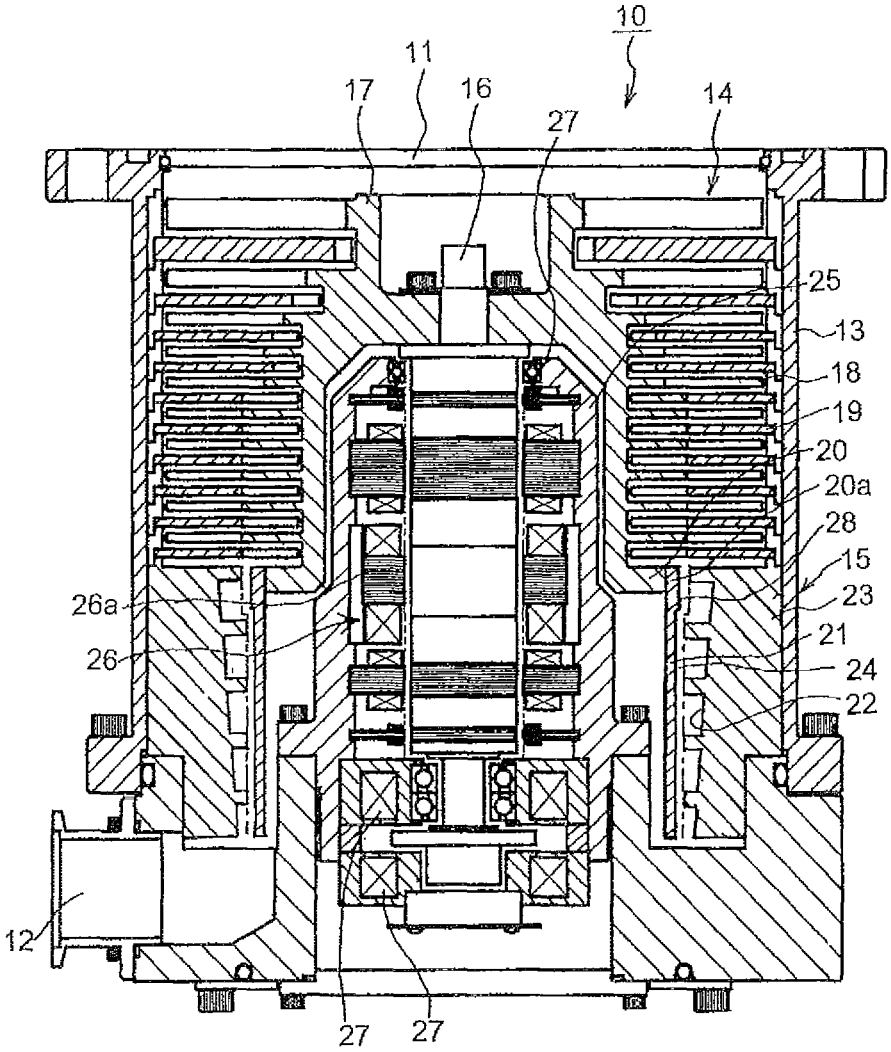
FIG. 1 is a vertical cross-sectional diagram of a vacuum pump in an embodiment of the present invention.

Preferred embodiments of the vacuum pump of the present invention are explained below with reference to FIG. 1 to FIG. 3. FIG. 1 is a vertical cross-sectional diagram of a vacuum pump according to the present invention.

In FIG. 1, a vacuum pump 10 comprises a chassis 13 that has an intake port 11 and an exhaust port 12. Inside the chassis 13 there is provided a turbo-molecular pump section 14 at the top, and a cylindrical thread groove pump section 15 below the turbo-molecular pump section 14; and there is formed an exhaust passage 24 that passes through the interior of the turbo-molecular pump section 14 and the thread groove pump section 15 and that communicates the intake port 11 with the exhaust port 12.

More specifically, the exhaust passage 24 elicits communication between a gap formed between the inner peripheral face of the chassis 13 and the outer peripheral face of a below-described rotor 17 that opposes the turbo-molecular pump section 14, and a gap between the inner peripheral face of a stator 23 at the outer peripheral face of a below-described cylindrical rotor 21 of the thread groove pump section 15. Also, the exhaust passage 24 is formed so as to elicit communication between the intake port 11 and the upper end side of the gap on the turbo-molecular pump section 14 side, and communication between the exhaust port 12 and the lower end side of the gap on the thread groove pump section 15 side.

The turbo-molecular pump section 14 results from combining multiple rotor blades 18, 18 . . . projecting from the outer peripheral face of the rotor 17, made of an a aluminum alloy and fixed to a rotating shaft 16, with multiple stator blades 19, 19 . . . that project from the inner peripheral face of the chassis 13.

The thread groove pump section 15 comprises: the cylindrical rotor 21 that is press-fitted and fixed, for instance using an adhesive or the like, to a joint 20*a*, i.e. to the outer periphery of a flange-like annular section 20 that is protrudingly provided at the outer peripheral face of the lower end section of the rotor 17 in the turbo-molecular pump section 14; and the stator 23, which opposes the cylindrical rotor 21, with a small gap between the outer periphery of the cylindrical rotor 21 and the stator 23, and in which there is disposed a thread groove 22 that is formed by the above-mentioned small gap and a part of the exhaust passage 24. The depth of the thread groove 22 is set so as to grow shallower in the downward direction. The stator 23 is fixed to an inner face of the chassis 13. The lower end of the thread groove 22 communicates with the exhaust port 12 at the furthest downstream side of the exhaust passage 24. The rotor 17 of the turbo-molecular pump section 14 and the joint 20*a* of the cylindrical rotor 21 of the thread groove pump section 15 are disposed upstream of the exhaust passage 24.

A rotor 26*a* of a high-frequency motor 26, such as an induction motor or the like that is provided in a motor chassis 25, is fixed to an intermediate section of the rotating shaft 16. The rotating shaft 16 is supported on a magnetic bearing, and is provided with upper and lower protective bearings 27, 27.

The cylindrical rotor 21 is obtained by shaping a FRP material to a cylindrical shape. The cylindrical rotor 21 is a composite layer that results from combining, for instance, hoop layers, in which fibers are aligned in the circumferential direction, so as to share forces in both the circumferential direction and the axial direction, with a helical layer, in which fibers are aligned in an angle of 45 degrees or more with respect to the circumferential direction.

A resin material is sprayed onto a site, at an upper end section corresponding to the joint 20*a*, of the rotor 17 of the turbo-molecular pump section 14 and of the cylindrical rotor 21 in the thread groove pump section 15, i e. at the outermost layer portion of the upper end section of the cylindrical shape rotor 21, so that the interior of the recesses in the surface is filled up with the resin material and is rendered smooth thereby.

The operation of the vacuum pump illustrated in FIG. 1 is explained next. Gas that flows in through the intake port 11, as a result of driving by the high-frequency motor 26, is in a molecular flow state or in an intermediate flow state close to a molecular flow state. The rotor blades 18, 18 . . . that rotate in the turbo-molecular pump section 14 and the stator blades 19, 19 . . . that project from the chassis 13 impart a downward momentum to the gas molecules, and the high-speed rotation of the rotor blades 18, 18 . . . causes the gas to be compressed and to move downstream.

The compressed and moving gas is guided, in the thread groove pump section 15, by the rotating cylindrical rotor 21, and by the thread groove 22 that becomes shallower downstream along the stator 23 that is formed having a small gap with respect to the cylindrical rotor 21. The gas flows through the interior of the exhaust passage 24 while being compressed up to a viscous flow state, and is discharged out of the exhaust port 12.

If the cylindrical rotor 21 has not been subjected to a predetermined finish processing in a case where the cylindrical rotor 21 is formed through shaping of a FRP material to a cylindrical shape, then the gap between the cylindrical rotor 21 and the opposing stator 23 must be increased on account of the rugged state of the surface of the cylindrical rotor 21. In the vacuum pump 10 of the present embodiment, however, the joint 20*a* between the rotor 17 of the turbomolecular pump section 14 and the cylindrical rotor 21 of the thread groove pump section 15 is disposed upstream of the exhaust passage 24, where the pressure is lower than on the exhaust port 12 side, at which the influence of a wider gap is smaller. Therefore, gas is discharged through the exhaust port 12 without incurring a significantly lower discharge rate or compression ratio, even if there is a large gap between the cylindrical rotor 21 and the opposing stator 23.

In the vacuum pump 10 of the present embodiment, therefore, at least the portion of the joint 20*a*, which is acted upon by a load, in the cylindrical rotor 21 that is obtained by shaping a FRP material to a cylindrical shape, need not be subjected to finish processing after shaping of the cylindrical rotor 21. Accordingly, it becomes possible to solve the conventional problems of shredding the meandering fibers in the vicinity of the surface layer of the cylindrical rotor 21, caused finish processing, and occurrence of partial peeling, fraying and resulting damage of the fiber structure of the FRP material at times of high load (load weight). Moreover, the manufacturing process of the vacuum pump is made simpler, and hence manufacturing costs can be reduced.

Herein, a predetermined degree of precision can be secured by providing a processing allowance 28 in the outermost layer at the upper end section of the cylindrical rotor 21 corresponding to at least the joint 20*a*, and, after shaping of the cylindrical rotor 21, by carrying out finish processing only at the portion of the processing allowance 28, within the thickness range of the outermost layer of the processing allowance 28. Drops in discharge rate and compression ratio can be expected to be further reduced thereby.

Figure 2:
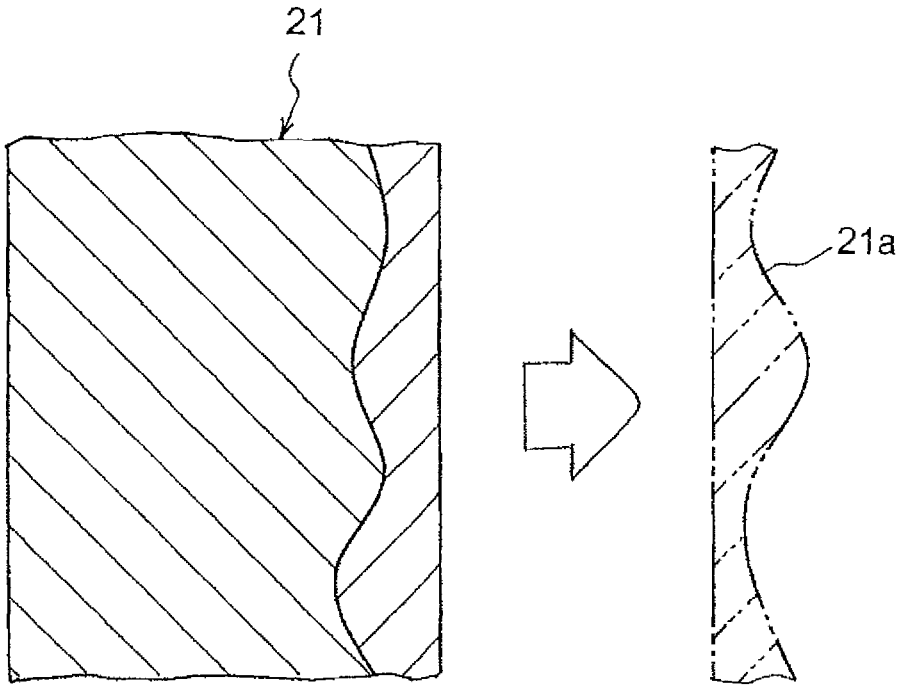
FIG. 2 is an explanatory diagram illustrating an embodiment of finish processing of a cylindrical rotor in a composite vacuum pump of the present invention illustrated in FIG. 1.

FIG. 2 is an explanatory diagram illustrating an embodiment of finish processing of a cylindrical rotor in the composite vacuum pump of the present invention illustrated in FIG. 1. For instance, a portion 21*a* of the outermost layer of the cylindrical rotor 21, as illustrated in FIG. 2, can be cut, within the thickness range of the outermost layer, in a case where the entire cylindrical rotor 21 undergoes finish processing after shaping of the cylindrical rotor 21.

Figure 3:
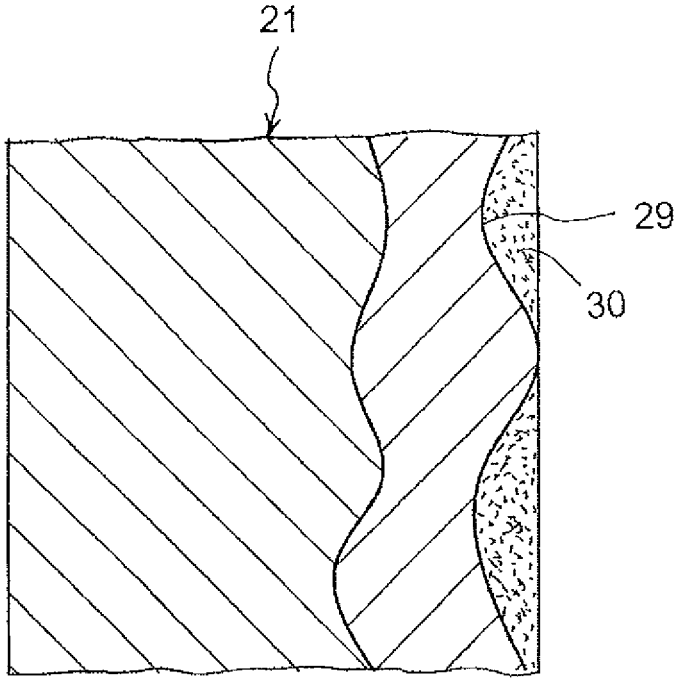
FIG. 3 is an explanatory diagram illustrating another embodiment of finish processing of a cylindrical rotor in a composite vacuum pump of the present invention illustrated in FIG. 1.

FIG. 3 is an explanatory diagram illustrating another embodiment of finish processing of a cylindrical rotor in the composite vacuum pump of the present invention illustrated in FIG. 1. In a case where the entire cylindrical rotor 21 undergoes finish processing after shaping of the cylindrical rotor 21, finish processing may be performed, for instance, by coating a resin material 30 into recessed portions 29 of the outermost layer of the cylindrical rotor 21, as illustrated in FIG. 3, within the thickness range of the outermost layer.

In the vacuum pump of the present invention, thus, two methods may be carried out, one method in which the joint 20*a* at the outer periphery of the cylindrical rotor 21 comprising FRP is not subjected to finish processing, and a method in which the joint 20*a* is subjected to finish processing. In the former case, where the joint 20*a* at the outer periphery of the cylindrical rotor 21 undergoes no finish processing, the FRP surface is ordinarily rugged, and therefore the gap (clearance) between the component (i.e. the flange-like annular section 20 of the rotor 17) that opposes the outer periphery of the cylindrical rotor 21 (FRP) must be made wider. In the embodiment of the present invention, however, the joint 20*a* is disposed upstream of the exhaust passage 24; as a result, FRP can be used even if the surface thereof is significantly rugged through not having been subjected to finish processing. That is, because the influence of clearance widening is small at a site of low pressure upstream of the exhaust passage 24, even if the clearance with respect to an opposing component is large.

In the latter case, where the joint 20*a* of the outer periphery of the cylindrical rotor 21 comprising FRP is subjected to finish processing, a processing allowance is provided on the outermost layer of the joint 20*a*, and the finish processing is carried out within the range of the processing allowance of the outermost layer. Herein, the finish processing of the processing allowance is carried out in accordance with a method that involves coating a resin material, clamping the FRP in a semicircular mold or the like and injecting a resin material, or winding helical fibers of FRP at a winding angle no greater than 45 degrees.

An explanation follows next on the reason why finish processing of the fiber-reinforced plastic material (FRP) needs to be performed in a case where the joint 20*a* is not provided upstream of the exhaust passage 24. The evacuation performance of the thread groove pump section 15 in which FRP is used as the cylindrical rotor 21 is influenced, to a high degree, by the clearance between the rotating blades (rotor blades 18) and the chassis 13 of the thread groove pump section 15. Therefore, the clearance must be maintained as small as possible.

On the other hand, surface ruggedness occurs on account of winding unevenness upon shaping of FRP through fiber winding. Also, the fiber winding density fluctuates depending on the degree of tension applied during fiber winding. The finished dimensions exhibit therefore large variability. In consequence, the clearance cannot be made smaller unless the surface of the cylindrical rotor 21 is subjected to finish processing. That is, the irregularities on the surface of the FRP must be reduced as much as possible through finish processing of the outer periphery of the FRP.

The reason why a substantial load acts on the FRP is explained next. The cylindrical rotor 21 is supported by the magnetic bearing in a contact-less manner, and hence heat dissipation in the rotating blades (rotor blades 18) is poor. Accordingly, the FRP is pushed wide on account of the thermal expansion of the aluminum alloy that is press-fitted on the inward side. A substantial load acts on the FRP as a result.

As a characterizing feature of the manner in which the above inconvenience is eliminated, the FRP is wound in a state where waviness is imparted along the irregularities of the surface. As a result, the fibers split at the ridges of the undulated portions during the finish processing. No load acts on the split fibers upon pushing wide of the FRP on account of the thermal expansion of the aluminum alloy. In consequence, a shear force acts on the cylindrical rotor 21. If the strength limit of the resin material that binds the fibers together is exceeded at this time, cracks appear on the resin, and fraying occurs. In ordinary applications, the occurrence of fraying is not a problem. In the case of a high-speed rotating body, however, fraying is problematic in that the centrifugal force at the frayed portion causes the cracks in the resin to propagate faster, so that entire fibers peel off. In the present embodiment, therefore, the above problem is solved by taking protective countermeasures to prevent shredding fibers that are acted upon by a load in the circumferential direction.

The surface treatment method of the FRP is explained next in further detail. A resin layer may be provided in the surface, by spraying, brush-coating, casting or the like, in a case where no finish processing is carried out in the surface treatment of the FRP, as described above. In the latter case, where a resin layer is provided on the surface of the FRP, finish processing is performed within the thickness range of the resin layer. A further finish processing need not be carried out if the resin layer is formed on the surface using a mold, since shape and dimensional precision, among others, is secured in that case.

In another surface treatment method of the FRP, a layer resulting from winding fibers helically, within a range of ±45 degrees with respect to the axial direction of the cylindrical rotor 21, may be provided on the surface of the FRP. In this case, winding of the fibers within and range of ±45 degrees with respect to the axial direction of the cylindrical rotor 21 allows reducing the shear force that is generated upon pushing wide of the press-fit section on account of thermal expansion. In this case as well, the finish processing is performed within the thickness range of the layer in which the fibers are wound. The FRP press-fit section is disposed upstream of the exhaust passage 24. The influence of a widening of the clearance with respect to the fixed section can be reduced at such a site where pressure is low.

In summary, in a vacuum pump having the rotor 17 such that the cylindrical rotor 21 formed out of FRP to a substantially cylindrical shape by FRP is joined to the joint 20*a* of the flange-like annular section 20 of another material, and the cylindrical rotor 21 makes up a thread groove pump 15, the cylindrical rotor 21 is formed as a multilayer structure having a hoop layers in which fibers are aligned by less than 45 degrees with respect to the circumferential direction, and a protective countermeasure is provided, at the outer periphery of the outermost layer, so that fibers in the outermost layer from among the hoop layers are not shredded, at the joint 20*a* of the cylindrical rotor 21.

Herein, a resin layer is provided outside of the hoop layers so as to reduce irregularities in the surface of the cylindrical rotor 21, at least at the portion at which the cylindrical rotor 21 is joined to the joint 20*a*. Once the resin layer has been provided, the resin layer is subjected to removal processing within the thickness range of the resin layer. The resin layer can be formed beforehand by resin casting.

Also, a helical layer in which fibers are aligned at an angle of 45 degrees or more with respect to the circumferential direction may be provided outside of the hoop layers, at the portion where the cylindrical rotor 21 of FRP is joined to the joint 20*a*. Once the helical layer has been provided, the fibers wound in the helical layer, and the resin around the fibers, may be subjected to removal processing within the thickness range of the helical layer.

Alternatively, the range of removal of the outer periphery of the cylindrical rotor 21, which is formed in such a manner that a hoop layers is the outermost layer, may be set to at least a part of a portion of the cylindrical rotor 21 other than the joint 20*a*. Finish processing of the outer periphery of the cylindrical rotor 21 need not be carried out if the joint 20*a* is provided upstream of the exhaust passage 24 in the thread groove pump section 15.

Specific embodiments of the present invention have been explained above, but the present invention is not limited to those embodiments, and may accommodate various improvements without departing from the spirit and scope of the invention. Such improvements are encompassed, as a matter of course, by the present invention.

Other than in vacuum pumps, as described above, the present invention can also be used in various devices that utilize a cylindrical rotor obtained by shaping an FRP material to a cylindrical shape.

EXPLANATION OF REFERENCES

10 Vacuum Pump
11 Intake Port
12 Exhaust Port
13 Chassis
14 Turbo-Molecular Pump Section
15 Thread Groove Pump Section
16 Rotating Shaft
17 Rotor
18 Rotor Blades
19 Stator Blades
20 Flange-Like Annular Section
20*a* Joint
21 Cylindrical Rotor
21*a* A Portion of the Outermost Layer
22 Thread Groove
23 Stator
24 Exhaust Passage
25 Motor Chassis
26 High-Frequency Motor
26*a* Rotor
27 Protective Bearings
28 Processing Allowance
29 Recessed Portions of the Outermost Layer
30 Resin Material

What is claimed is:

1. A vacuum pump having a rotor such that a cylindrical rotor formed in a substantially cylindrical shape out of a fiber-reinforced composite material is joined to a rotor of another material and forming a cylindrical pump section and removal processing is applied to at least a part of an outer periphery of the cylindrical rotor, wherein said cylindrical rotor is formed as a multilayer structure that includes hoop layers in which fibers are oriented in less than 45 degrees with respect to a circumferential direction, and wherein said removal processing is not applied at least at a joining portion of said cylindrical rotor so as to prevent shredding fibers in the layer that constitutes an outermost layer, from among said hoop layers.

2. The vacuum pump according to claim 1, wherein in said cylindrical rotor that is formed in such a manner that said hoop layers constitute an outermost layer.

3. The vacuum pump according to claim 2, wherein said joining portion is provided upstream of an exhaust passage of said cylindrical pump section.

4. The vacuum pump according to claim 1, wherein said joining portion is provided upstream of an exhaust passage of said cylindrical pump section.

5. A vacuum pump having a rotor such that a cylindrical rotor formed in a substantially cylindrical shape out of a fiber-reinforced composite material is joined to a rotor of another material and forming a cylindrical pump section, wherein said cylindrical rotor is formed as a multilayer structure that includes hoop layers in which fibers are oriented in less than 45 degrees with respect to a circumferential direction, a protective countermeasure is provided at an outer periphery of an outermost layer, from among said hoop layers, so as to prevent shredding fibers in the layer that constitutes said outermost layer at least at a joining portion of said cylindrical rotor, and said protective countermeasure is a resin layer further provided outside of said hoop layers so as to reduce irregularities in the surface of said cylindrical rotor.

6. The vacuum pump according to claim 5, wherein after said resin layer is provided, the resin layer is subjected to removal processing within a thickness range of the resin layer.

7. The vacuum pump according to claim 6, wherein said resin layer is formed by cast article.

8. The vacuum pump according to claim 7, wherein said joining portion is provided upstream of an exhaust passage of said cylindrical pump section.

9. The vacuum pump according to claim 6, wherein said joining portion is provided upstream of an exhaust passage of said cylindrical pump section.

10. The vacuum pump according to claim 5, wherein said resin layer is formed by cast article.

11. The vacuum pump according to claim 10, wherein said joining portion is provided upstream of an exhaust passage of said cylindrical pump section.

12. The vacuum pump according to claim 5, wherein said joining portion is provided upstream of an exhaust passage of said cylindrical pump section.

13. A vacuum pump having a rotor such that a cylindrical rotor formed in a substantially cylindrical shape out of a fiber-reinforced composite material is joined to a rotor of another material and forming a cylindrical pump section, wherein said cylindrical rotor is formed as a multilayer structure that includes hoop layers in which fibers are oriented in less than 45 degrees with respect to a circumferential direction, a protective countermeasure is provided at an outer periphery of an outermost layer, from among said hoop layers, so as to prevent shredding fibers in the layer that constitutes said outermost layer at least at a joining portion of said cylindrical rotor, and said protective countermeasure is a helical layer provided outside of said hoop layers, the helical layer has fibers oriented in 45 degrees or more with respect to the circumferential direction.

14. The vacuum pump according to claim 13, wherein after said helical layer is provided, fibers wound in the helical layer and resin around the fibers are subjected to removal processing within a thickness range of the helical layer.

15. The vacuum pump according to claim 14, wherein said joining portion is provided upstream of an exhaust passage of said cylindrical pump section.

16. The vacuum pump according to claim 13, wherein said joining portion is provided upstream of an exhaust passage of said cylindrical pump section.

* * * * *